United States Patent [19]

Frecentese

[11] 4,263,728

[45] Apr. 28, 1981

[54] JOGGING SHOE WITH ADJUSTABLE SHOCK ABSORBING SYSTEM FOR THE HEEL IMPACT SURFACE THEREOF

[76] Inventor: Frank Frecentese, 20 Balmoral Crescent, White Plains, N.Y. 10607

[21] Appl. No.: 7,983

[22] Filed: Jan. 31, 1979

[51] Int. Cl.[3] ..... A43B 5/00; A43B 13/20; A43B 5/06

[52] U.S. Cl. ..... 36/129; 36/29; 36/59 C

[58] Field of Search ..... 36/129, 29, 28, 3 R, 36/3 B, 59 C; 128/594

[56] References Cited

U.S. PATENT DOCUMENTS

| | | | |
|---|---|---|---|
| 2,020,240 | 11/1935 | Cochran | 36/29 X |
| 2,090,881 | 8/1937 | Wilson | 36/59 C |
| 2,553,616 | 5/1951 | Walls | 36/29 |
| 4,008,530 | 2/1977 | Gager | 36/28 |
| 4,129,951 | 12/1978 | Petrosky | 36/29 |

FOREIGN PATENT DOCUMENTS

| | | | |
|---|---|---|---|
| 2460034 | 6/1976 | Fed. Rep. of Germany | 36/29 |
| 2342677 | 9/1977 | France | 36/29 |
| 16240 | of 1893 | United Kingdom | 36/29 |

*Primary Examiner*—James Kee Chi

*Attorney, Agent, or Firm*—McAulay, Fields, Fisher, Goldstein & Nissen

[57] ABSTRACT

A jogging shoe has an adjustable shock absorbing system for the heel impact surface in the form of an inflatable air chamber with downwardly extending pump-like pegs and the hollow cavity interiors in communication with the air chamber. When the jogging shoe impacts against the running surface, the pegs depress, compressing air contained in their cavities into the air chamber which distributes the impact force across the entire sole of the shoe. After the pegs depress, the air chamber can also partially compress to absorb the remainder of the force. Thus a two-step shock absorption and distribution system is provided.

6 Claims, 3 Drawing Figures

JOGGING SHOE WITH ADJUSTABLE SHOCK ABSORBING SYSTEM FOR THE HEEL IMPACT SURFACE THEREOF

BACKGROUND OF THE INVENTION

A president of the American Medical Jogger's Association, an affiliate of the American Medical Association, described the jogging experience this way: "I am convinced that jogging extends life." The National Jogging Association counts more than 10,000 dues paying members. The Roadrunners Club of America founded in 1957, now has more than 100 chapters across the country with 50,000 members.

From the proliferation of popular paperback books and specialized magazines, it is obvious that "jogging" as an exercise and a means to maintain one's health, is presently enjoying widespread popularity. Anyone doubting this conclusion need only pause a moment on a pleasant spring day in a park in any city, or walk along the roads in any suburb.

One reason for the popularity of jogging is the apparent ease with which it can be accomplished and the widespread consensus that there is great benefit to one's health with a minimum of danger from over exertion, if jogging is approached with some care, assuming that the jogger is in moderately good health. Of course, a physical examination should be made by competent medical practitioners before a program of jogging for health is attempted.

Although jogging has attained wide popular acceptance, there are medical and other personnel who regard jogging as less than beneficial. These people point out that jogging may be too strenuous an exercise for some people and, for the others, the trauma to the body caused by constant impact with hard surfaces normally found in city and surburban streets, can do serious damage to the human body. A list of common problems encountered by joggers or runners include: Achilles Pendinitis, Chrondromalacia of the knee, heel-bone damage, Leg and Foot bursitis, Shin Splints, leg-muscle pulls, back pain, muscle cramp, and twisted ankles.

The usual jogging style, as opposed to running and normal walking, normally results in the weight of the jogger landing on four or five square inches of the heel surface of the shoe. The impact force has been estimated at about three to four times the weight of the jogger. A jogger weighing 180 lbs. would therefor create a force of 720 lbs of shock on one heel. Considering the fact that each heel impacts the ground about 800 times per mile, it is easy to see why joggers can suffer from various ailments associated with impact which must be absorbed by the bones and muscles.

A number of different styles of jogging shoe have evolved in an attempt to absorb or mitigate the impact received by the jogger's heel, especially when a jogger is running on concrete or macadam surfaces normally encountered in urban and surburban jogging.

Sponge rubber material for use on the heel and sole of jogging shoes has been found generally inadequate in that it is too soft to provide adequate shock resistance. The harder materials such as nylon and high density rubber are too hard and transmit too much of the impact to the heel of the jogger. Often a combination of crepe and gum rubber are used in forming the sole of the joggers' shoe.

One popular style uses a crepe sole lined with a rubber bottom layer having pegs disposed downwardly from the harder rubber layer. Often the hard rubber layer curves around the back of the shoe to cover the rear of the heel. Other styles are more like sneakers, and, in fact, many people jog wearing just sneakers in spite of the probable inadequacy of most sneakers to absorb the tremendous impact to the heel, from jogging.

Although most prior art shoe designs have, to a greater or lesser extent, been able to mitigate the impact transmitted from the heel of the shoe to the heel of the jogger, they suffer from several potential related inadequacies.

The amount of shock absorption built into the heel of a jogging shoe is controlled by the available materials and the design of the manufacturer. As a result, a lighter weight person having large feet may have to use a shoe designed to absorb the shock of a much heavier person, while a heavy weight person having small feet will have the opposite problem, assuming that the manufacturer of the shoe has used some logical design means to build different shock absorbing characteristics into their shoes. In any case, there is generally no provision for adjustment for control of the amount of shock absorption obtainable in any particular shoe, although the same shoe may be used by joggers of greatly varying weights on surfaces varying from concrete to dirt or grass.

In order to create cushioning, support, and comfort presently the following devices are often inserted into existing jogging or running shoe:

heel lifts, heel cups, arch supports, inserts (custom made or molded supports); and insoles.

PRIOR ART

Air filled sacs have been used as orthopedic cushions to replace the inner sole of shoes for a number of years, although I am unaware of any which were designed to absorb the tremendous impact at the heel of the shoe which is encountered by a jogger, notwithstanding the fact that people have jogged or run probably as long as man has existed.

Air cushions have been designed to accomplish a number of varied purposes including to provide an orthopedically shaped surface generally conforming to the curvature of the normal human foot, to provide means for softening the jar incident to the operation of walking, to provide means concealed within the shoe for increasing the apparent height of a human being, to correct a manner of walking of the wearer, and to form a comfortable and natural support for the arch of the foot. See U.S. Pat. No. 1,154,491 to Deol for an "Orthopedic Cushion." A similar device is shown in U.S. Pat. No. 1,500,583 to Glanzer for a "Pneumatic Sole," which is devised to provide a pneumatic inner sole for boots, shoes and the like whereby walking and standing is rendered less fatiguing than ordinarily. The Glanzer sole is designed to conform to the foot so as to support the same in a uniform and comfortable manner. The Glanzer device is specifically designed and claimed as a pliable body being hollow except at the heel portion, and includes an air valve extending through the heel whereby the chamber can be inflated.

"Air-Filled Sandals" are disclosed in U.S. Pat. No. 2,981,010 to Aaskov, U.S. Pat. No. 2,981,010. The Aaskov sandal is formed in two inflatable parts which may be deflated by means of valves, whereby the parts can be separated and the worn outer part replaced. By designing the sandal with longitudinal cellular construction, the various portions of the foot wear article are insured substantially free flexibility in a longitudinal direction but limited in free flexing in a lateral direction to provide improved cushioning action which greatly contributes to improved wearing comfort, according to the disclosure.

Other special purpose inflatable inner sole devices are also shown in U.S. Pat. No. 2,365,807 to Dialynas for "Pneumatic or Cushion Arch Support for Shoes," and U.S. Pat. No. 2,600,957 to Bartis for "Pneumatic Arch Support."

Although these references all use an inflatable or an inflated air cushion, none of them show devices which are designed to absorb the tremendous impact forces repeatedly generated by the impact of a jogger's jogging shoe when he is jogging especially on hard surfaces. Most of these prior art inflatable devices are intended to replace or be inserted above the inner sole of a shoe to conform to the wearer's foot. None of them show a two stage impact absorption which may be necessary for satisfactory impact shock absorption or distribution. None of them show the unique structure of the present invention as described below with respect to the presently preferred embodiment.

It is therefore an object of the present invention to provide a jogging shoe with enhanced shock absorbing or shock distributing characteristics for the impact receiving heel portion.

It is a related object of this invention to provide a shock absorbing jogging shoe wherein the amount of shock absorption or shock distribution can be adjusted as required by the weight of the jogger, the jogger's personal style and preferences, and the type of surface over which the jogger runs.

It is a further related object to provide a jogging shoe with shock absorption or distributing characteristics which can be adjusted by the ultimate purchaser or user of the shoe.

BRIEF DESCRIPTION OF THE DISCLOSURE

Briefly, the present invention provides a large compressible air chamber formed primarily in the heel of a jogging shoe, which air chamber is in communication with a plurality of compressible air pumps extending downwardly from the sole of the shoe. Impact against the pumps causes them to depress and compress air into the air chamber thereby absorbing or distributing the impact. Thereafter the air chamber may compress further to absorb additional impact forces if necessary.

Preferably the pumps are formed as hollow downwardly projecting pegs which are outwardly similar to the prior art solid pegs. The hollow cavity in the "pegs" opens upwardly into the air chamber.

The air chamber extends substantially the full extent of the heel of the shoe, where impact occurs, and across most of the rest of the bottom of the shoe to distribute impact across most of the jogger's foot.

The air chamber and hollow pegs are preferably formed of rubber similar to that used in the tire industry.

An air valve, which may be of usual construction to permit inflation of the air chamber and pegs is formed through the heel or side of the sole, preferably recessed to avoid accidental damage.

In use, impact of the jogger's heel against the running surface is first absorbed by the relatively small area of the air pumps or pegs, which first contact the running surface, by the compression of air in the pegs or pumps into the main air chamber thereafter to be distributed across the extent of the chamber. If the impact is sufficiently great to substantially depress the air pumps or pegs, the air chamber itself will partially compress to further absorb and distribute the impact force. In this manner, a tremendous amount of shock impact can be absorbed and distributed by the shock absorbing system irrespective of the portion of the shoe heel which contacts the running surface first.

A second feature of the shock absorbing system of the present invention is the air valve whereby air, or other compressible fluids, can be injected into the air chamber or removed therefrom, depending on the amount of shock absorption necessary under these circumstances. Thus, the weight of the jogger, the type of surface the jogger runs on, and to some extent, the jogger's style—that is the portion of the jogging shoe or the size of the area of the jogging shoe which contacts the running surface first for the particular jogger—can be accommodated.

A further feature is the reduction in weight afforded a jogging shoe in which the sole of the shoe is replaced with a compressed air chamber.

DESCRIPTION OF THE PREFERRED EMBODIMENT

Figure 1:
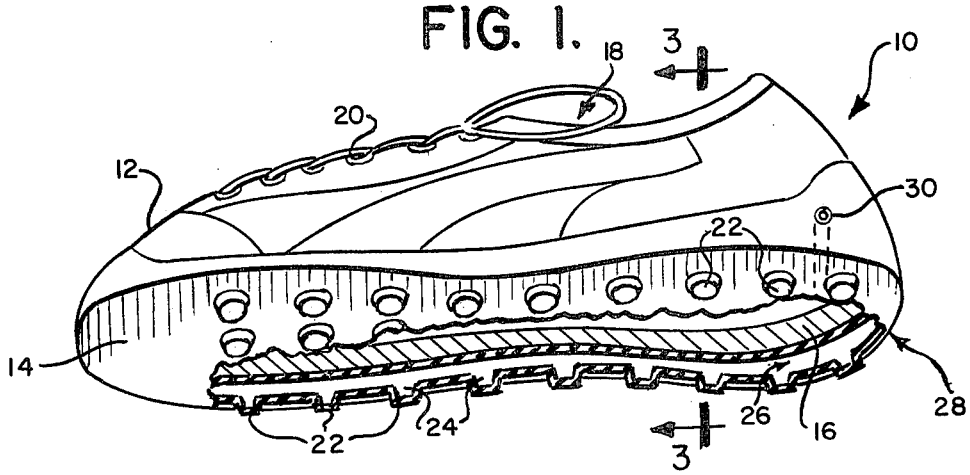
FIG. 1 is a perspective view of a jogging shoe, partially in section, with adjustable shock absorbing system for the heel impact surface thereof.
Figure 3:
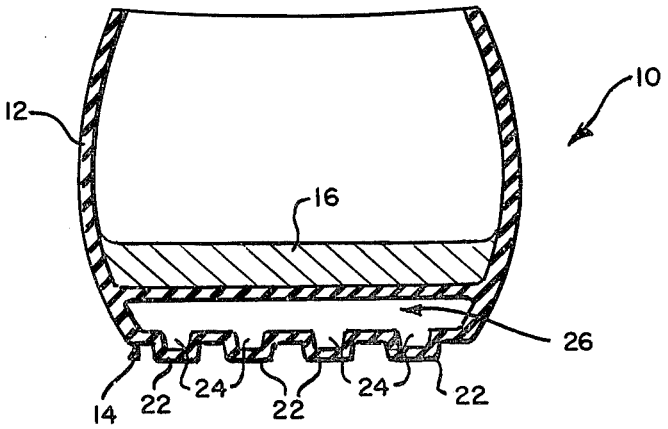
FIG. 3 is a sectional view thereof along line 3—3 of FIG. 1.

With reference to FIGS. 1 and 3, a jogging shoe 10 has an upper body portion 12 an outer sole 14 and an inner sole 16.

The upper body portion 12 and the inner sole 16 may be of any usual construction for jogging shoes. As can be seen in FIG. 1, the upper body portion has an upwardly open foot receiving entrance 18 which is adjustably closed about the foot using laces 20.

Figure 2:
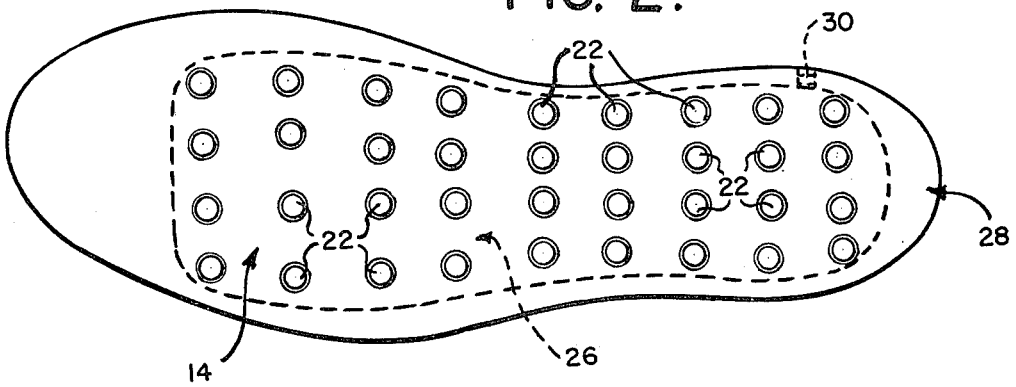
FIG. 2 is a bottom plan view thereof.

With reference to FIGS. 1 and 2, the outer sole 14 is preferably formed with pegs 22 covering a major portion of the bottom of the shoe 10. With reference to FIG. 3, the pegs 22 have a hollow cavity 24 communicating with air chamber 26. Air chamber 26 extends from the heel 28 throughout most of the outer sole 14 as shown in phantom in FIG. 2.

An air valve 30 communicates with air chamber 26 to permit adjustable inflation of the air chamber 26. The valve 30 may be of any usual design, but should be recessed, as shown in FIG. 2, to reduce the possibility of damage. In addition, mounting through the side of the heel will reduce the chance of impact damage which might occur with a valve extending out the rear of the heel.

OPERATION OF THE SHOCK ABSORBING SYSTEM

With reference to FIGS. 1 and 3, the operation of the jogging shoe 10 is as follows:

The shock absorbing system will need to be inflated to an initial pressure for use. Normally the initial pressure will be less than 30 pounds per square inch, depending on the weight of the person using the shoe.

The shoe will then need to be used to determine if sufficient and comfortable shock absorption or shock distribution is attained. If necessary, the amount of pressure within the shock absorbing system can be adjusted through valve 30.

Shock or impact is absorbed and distributed by the system as a result of the air pump action of the hollow pegs 22. Impact on a hard surface will cause pegs 22 at the impact point to depress and compress the air contained therein into chamber 26. This will distribute the impact across the sole and partially absorb the impact by the compression of air. Because the pegs only display about 3 or 4 square inches, depending on the point of impact, the impact may be sufficient to substantially depress them. If the pegs 22 are substantially depressed, the larger surface area then displayed by the bottom of the air chamber 26, will be compressed and absorb the excess impact. Thus, shock absorption and distribution throughout the air chamber area is in a two stage form. Initially, and depending on the pressure within the shock absorbing system, the small surface area displayed by the pegs absorbs the main impact and depresses in doing so. Thereafter, the main body of air chamber 26 is impacted and compressed to absorb the remaining force.

In the preferred construction, as shown in FIG. 1, the sole is wedge-shaped and tapers toward the front of the shoe. This provides a larger air chamber volume at the heel 28 of the sole where the maximum impact forces are expected to occur. Enhanced impact or shock absorption capacity is thereby imparted to the shoe.

The above is by way of illustration of the presently preferred embodiment and is not intended as limiting to the invention claimed herein. Other embodiments or modifications within the scope of the invention, would be obvious to persons of ordinary skill in the arts. It is therefore intended that the scope of the invention be measured only as in the Claims which follow:

What is claimed is:

1. A jogging shoe with adjustable two stage shock absorbing system for the heel impact surface thereof, said jogging shoe having an upper body portion, an outer sole with heel and toe portions, and an inner sole, comprising:

Said outer sole having an air chamber extending through a major portion thereof including extending through substantially the full extent of the heel portion; and a plurality of downwardly extending depressable projections disposed spaced apart from each other and extending downwardly over substantially the full extent of the heel portion of the outer sole of the shoe for longitudinal and lateral stability, said projections each having a hollow cavity in communication with said air chamber; impact against said projections causing air contained therein to be compressed into said air chamber to provide a first stage of shock absorption, said air chamber being further operable to be compressed to absorb shock and provide a second stage of shock absorption.

2. The jogging shoe of claim 1 further comprising an air valve in communication with said air chamber whereby the air pressure in said chamber can be adjusted.

3. The jogging shoe of claim 2 wherein said air valve is fully recessed into the heel.

4. The jogging shoe of claim 3 wherein said valve is disposed through a side of said heel to avoid impact when the shoe is used.

5. The jogging shoe of claim 1, 2, 3 or 4 wherein said air chamber is wedge-shaped and tapers downward toward the toe portion thereof to provide an enlarged air chamber portion in the heel.

6. The jogging shoe of claim 1, 2, 3 or 4 wherein a forward portion of said outer sole is free of said projections.

* * * * *